US008813319B2

(12) United States Patent
Ogura

(10) Patent No.: US 8,813,319 B2
(45) Date of Patent: Aug. 26, 2014

(54) SLIDE FASTENER WITH SEPARABLE BOTTOM END STOP

(75) Inventor: Suguru Ogura, Toyama (JP)

(73) Assignee: YKK Corporation (JP)

( * ) Notice: Subject to any disclaimer, the term of this patent is extended or adjusted under 35 U.S.C. 154(b) by 95 days.

(21) Appl. No.: 13/255,325

(22) PCT Filed: Mar. 27, 2009

(86) PCT No.: PCT/JP2009/056330
§ 371 (c)(1),
(2), (4) Date: Sep. 8, 2011

(87) PCT Pub. No.: WO2010/109656
PCT Pub. Date: Sep. 30, 2010

(65) Prior Publication Data
US 2012/0000040 A1 Jan. 5, 2012

(51) Int. Cl.
*A44B 19/38* (2006.01)

(52) U.S. Cl.
USPC ..... 24/434; 24/391; 24/435

(58) Field of Classification Search
USPC ..... 24/388, 433, 434, 435, 436, 391
See application file for complete search history.

(56) References Cited

U.S. PATENT DOCUMENTS

| | | | | |
|---|---|---|---|---|
| 4,078,279 | A * | 3/1978 | Heimberger | 24/434 |
| 4,221,026 | A | 9/1980 | Kanzaka | |
| 4,742,603 | A * | 5/1988 | Kasai | 24/433 |
| 6,088,888 | A | 7/2000 | Oda | |
| 7,882,602 | B2 * | 2/2011 | Himi | 24/433 |
| 8,146,214 | B2 * | 4/2012 | Peters et al. | 24/388 |
| 2003/0033695 | A1 | 2/2003 | Wang | |
| 2008/0040901 | A1 | 2/2008 | Himi | |
| 2012/0260468 | A1 * | 10/2012 | Nozaki et al. | 24/386 |

FOREIGN PATENT DOCUMENTS

| | | |
|---|---|---|
| JP | 53-93720 | 1/1980 |
| JP | 59-25227 Y2 | 7/1984 |
| JP | 60-97282 | 1/1987 |
| JP | 63-147764 U | 5/1990 |

(Continued)

OTHER PUBLICATIONS

International Search Report and Written Opinion, PCT international Patent Application No. PCT/JP2009/058476, mailed Aug. 4, 2009.

*Primary Examiner* — Robert J Sandy
*Assistant Examiner* — Michael Lee
(74) *Attorney, Agent, or Firm* — Kilpatrick Townsend & Stockton LLP

(57) ABSTRACT

A slide fastener with a separable bottom end stop according to the invention, includes: an insert member fixed to an end of one element row, and a pivot support member fixed to an end of the other element row. The insert member includes an insert plate portion fixed to the fastener tape, and a pivot shaft portion disposed on the insert plate portion. The pivot support member includes a box pin portion that extends from an end of the element row, a box portion of a nearly J shape, a protrusion that extends from the box pin portion, and a flat plate-like support portion that extends from the box portion. As a result, even if a separable bottom end stop receives lateral pulling force or pushing-up force in the coupling state of the element rows, it is possible to prevent the element rows from being decoupled.

1 Claim, 6 Drawing Sheets

(56) References Cited

FOREIGN PATENT DOCUMENTS

| | | | |
|---|---|---|---|
| JP | 11-221105 | | 8/1999 |
| JP | 2003-38214 | | 2/2003 |
| JP | 2003-38214 | A | 2/2003 |
| JP | 2008-43568 | A | 2/2008 |

* cited by examiner

SLIDE FASTENER WITH SEPARABLE BOTTOM END STOP

This application is a national stage application of PCT/JP2009/056330, which is incorporated herein by reference.

TECHNICAL FIELD

The invention relates to a slide fastener with a separable bottom end stop, and more particularly, to a slide fastener with a separable bottom end stop including an insert member and a pivot stopper body and having a structure capable of engaging the insert member with the pivot stopper body in two ways of engagement operations.

BACKGROUND ART

Conventionally, as a slide fastener with a separable bottom end stop, there has been known a slide fastener with a side open type separable bottom end stop that is capable of coupling left and right element rows by allowing an insert member disposed on one end of one element row to be inserted into and engaged with a pivot support member disposed on an end portion of the other element row from the side of the pivot support member.

Further, as a slide fastener with such a side open type separable bottom end stop, a slide fastener in which usability of the bottom end stop is improved is disclosed, for example, in Japanese Patent Application Laid-Open No. 2008-43568 (Patent Document 1).

As illustrated in FIG. 10, a slide fastener 61 with a separable bottom end stop 62 disclosed in Patent Document 1 includes a pair of left and right fastener stringers 66 in which element rows 65 are formed such that a plurality of independent synthetic resin fastener elements 64 are lined on left and right fastener tapes 63, a separable bottom end stop 62 disposed on one end portion of the element rows 65, and a slider (not shown).

In the slide fastener 61, the fastener element 64 is formed in a predetermined shape by performing injection molding on the fastener tape 63. As the slider that allows the element row 65 including the fastener elements 64 to pass through, a general slider that has been known in the past can be used.

The separable bottom end stop 62 includes an insert member 67 that is formed continuously from the element row 65, disposed at a lower end portion of the left fastener tape 63, and serves as an insert pin and a pivot stopper body 68 that is disposed at a lower end portion of the right fastener tape 63 and serves as a box pin and a box.

The insert member 67 includes an insert plate portion 67*a* of a thin plate form fixed to both front and back surfaces of the left fastener tape 63, a to-be-pivoted portion 67*b* (a pivot shaft portion) that is disposed to protrude in a tape front-back direction at a leading end portion (a rear end portion) of the insert plate portion 67*a* at a tape end portion side, a projecting portion 67*c* formed along the tape inner side edge of the insert plate portion 67*a*, a coupling portion (hook portion) 67*d* disposed at an end portion (a front end portion) of the insert plate portion 67*a* at the element row 65 side, and a recess portion 67*e* formed on the front and rear surfaces of the insert plate portion 67*a*.

Both the front and rear surfaces of the insert plate portion 67*a* are flat except the recess portion 67*e*, and the thickness of the insert plate portion 67*a* in the tape front-back direction is set to be smaller than an size of the clearance formed between upper and lower flanges of the slider. The insert plate portion 67*a* has a notch portion 67*f* that is cut toward the inside of the tape from the tape end portion side.

The pivot stopper body 68 includes a slider holding portion (a box pin portion) 68*a* that is formed on both front and rear surfaces of the right fastener tape 63, a pivot stopper portion (a box portion) 68*c* that is formed at a thickness thicker than the slider holding portion 68*a* via a step portion 68*b* and has a substantially J shape in the front view, and a reinforcement portion 68*d* that is formed closer to the tape inner side further than the slider holding portion 68*a* and increases the strength of fixing of the pivot stopper body 68 to the fastener tape 63. Further, an engaging concave groove 68*e* that engages the insert plate portion 67*a* is formed in part of the side surface of the slider holding portion 68*a* opposite to the insert plate portion 67*a* and part of the side surface of the pivot stopper portion 68*c* opposite to the insert plate portion 67*a*.

Further, the insert member opposing side edge of the slider holding portion 68*a* curves such that an intermediate portion thereof slightly expands toward the insert member 67. Further, when the slider slides to come in a contact with the step portion 68*b*, the slider holding portion 68*a* can be inserted into an element guide passage of the slider and hold the slider.

The pivot stopper portion 68*c* includes a pivot space 68*f* that is opened upward so that the to-be-pivoted portion 67*b* of the insert member 67 can be engaged or disengaged through the side of the pivot stopper body 68 and an inner peripheral surface 68*g* that comes in contact with the to-be-pivoted portion 67*b* inserted into the pivot space 68*f* and may rotatably engage the to-be-pivoted portion 67*b*. Further, a slit 68*h* is formed in a leading end portion of the pivot stopper portion 68*c* from the inner peripheral surface 68*g* to the outer peripheral surface. The groove width of the slit 68*h* in the tape front-back direction is set to be larger than the thickness of the insert plate portion 67*a*.

In the slide fastener 61 of Patent Document 1 with the separable bottom end stop 62 including the insert member 67 and the pivot stopper body 68, by inserting the to-be-pivoted portion 67*b* of the insert member 67 into the pivot stopper body 68 from the side of the pivot stopper body 68 in the state in which the slider is held on the pivot stopper body 68, the to-be-pivoted portion 67*b* is rotatably engaged with the pivot stopper portion 68*c* of the pivot stopper body 68.

Then, by rotating the insert member 67 centering on the to-be-pivoted portion 67*b* toward the pivot stopper body 68 in the state in which the to-be-pivoted portion 67*b* is engaged with the pivot stopper portion 68*c*, the insert plate portion 67*a* of the insert member 67 is inserted into the element guide passage through a tape groove formed between the upper and lower flanges of the slider. Thereafter, by sliding the slider along the element rows 65 in a coupling direction, the coupling portion (hook portion) 67*d* of the insert member 67 can be first engaged with the fastener element 64 adjacent to the pivot stopper body 68, and the left and right element rows 65 can be further coupled in order starting from the end portion at the separable bottom end stop 62 side.

Meanwhile, in the slide fastener 61, even by inserting the to-be-pivoted portion 67*b* of the insert member 67 into the pivot stopper body 68 from a shoulder mouth of the slider through the element guide passage of the slider in the state in which the slider (not shown) is held on the pivot stopper body 68, the to-be-pivoted portion 67*b* is rotatably engaged with the pivot stopper portion 68*c* of the pivot stopper body 68. Thereafter, by sliding the slider along the element rows 65 in the coupling direction, the left and right element rows 65 can be coupled in the same manner as described above.

That is, in the slide fastener 61 of Patent Document 1, when coupling the left and right element rows 65, the insert member 67 can be rotatably engaged with the pivot stopper body 68 by arbitrarily selecting a first operation of engaging the insert member 67 with the pivot stopper body 68 by directly inserting the to-be-pivoted portion 67*b* of the insert member 67 from the side of the pivot stopper body 68 or a second operation of engaging the insert member 67 with the pivot stopper body 68 by inserting the to-be-pivoted portion 67*b* through the element guide passage of the slider, thereby improving operability and convenience of the slide fastener 61.

Patent Document 1: Japanese Patent Application Laid-Open No. 2008-43568

DISCLOSURE OF INVENTION

Problem to Be Solved by the Invention

In the slide fastener 61 disclosed in Patent Document 1, the independent synthetic resin fastener element 64 formed by injection molding is disposed to sandwich the front and back tape surfaces of the fastener tape 63. Further, the independent fastener element 64 has the shape in which the front and back surface sides are symmetrical centering on the fastener tape 63. Thus, in the slide fastener 61, when coupling the left and right element rows 65, the left and right fastener elements 64 are firmly coupled at both the front tape surface side and the back tape surface side of the fastener tape 63.

In this case, the insert member 67 and the pivot stopper body 68 that constitute the separable bottom end stop 62 are formed in the shape in which the front and back surface sides are symmetrical so as to sandwich the front and back tape surfaces of the fastener tape 63 similarly to the fastener element 64. Particularly, the insert member 67 and the pivot stopper body 68 can easily secure the thickness in the tape front-back direction, and thus, for example, even if the separable bottom end stop 62 receives pushing-up force in the tape front-back direction, the insert member 67 or the pivot stopper body 68 is not easily bent.

For this reason, for example, even if the element rows 65 or the separable bottom end stop 62 receives pushing-up force in the tape front-back direction or lateral pulling force in the tape width direction in the state in which the left and right element rows 65 are coupled, the slide fastener 61 of Patent Document 1 can maintain the coupling state of the element rows and prevent the occurrence of decoupling.

However, in the slide fastener having the element rows formed by the independent fastener elements 64 that are injection-molded as in Patent Document 1, since the fastener elements 64 are fixed while sandwiching the front and back tape surfaces of the fastener tape 63, there has been a problem in that flexibility of the slide fastener is lower than that of a slide fastener having element rows formed by coil- or zigzag-shaped continuous fastener elements.

Meanwhile, for example, when the slide fastener having the element rows formed by the coil- or zigzag-shaped continuous fastener elements employs an insert member and a pivot stopper body as a separable bottom end stop as in Patent Document 1 and the separable bottom end stop is capable of engaging the insert member with the pivot stopper body by two different kinds of engagement operations, there has been a problem in that the element rows are easily decoupled when the separable bottom end stop receives pushing-up force.

Specifically, in the slide fastener having the coil- or zigzag-shaped continuous fastener elements, the element rows are formed by sewing left and right continuous fastener elements to one surface (an upper surface) side of the fastener tape using a sewing thread.

Further, the slider used in the slide fastener has the upper and lower flanges disposed on the left and right side edges of upper and lower blades, and the tape groove that the fastener tape passes through is formed between the upper and lower flanges.

In this case, the tape grooves disposed on the left and right of the slider are formed such that the height positions of the tape grooves in the vertical direction are set closer to the lower blade side further than an intermediate portion between the upper and lower blades since the continuous fastener elements are sewed to the upper surface side of the fastener tape as described above. Further, in order to properly hold the posture of the continuous fastener elements and stably couple the left and right continuous fastener elements, the tape grooves are formed to have the groove width narrower than, for example, when the element row is formed by the independent fastener elements 64.

For this reason, when the separable bottom end stop 62 having the insert member 67 and the pivot stopper body 68 illustrated in FIG. 10 is disposed in the slide fastener having such continuous fastener elements, the insert plate portion 67*a* of the insert member 67 needs to be formed at a height dimension (the thickness), in the tape front-back direction, that is thin enough for the insert plate portion 67*a* to be inserted into the tape groove of the slider. Further, in this case, since a gap between the tape groove and the lower blade of the slider is narrower than a gap between the tape groove and the upper blade, the thickness of the insert plate portion 67*a* at the back tape surface side had to be thinner than that at the front tape surface side.

However, when the thickness of the insert plate portion 67*a* of the insert member 67 is thinly set as described above, the stiffness of the insert plate portion 67*a* deteriorates. Thus, when the separable bottom end stop 62 receives lateral pulling force in the tape width direction or pushing-up force in the tape front-back direction in the state in which the element rows of the slide fastener are coupled, the insert plate portion 67*a* is easily bent to shrink in the tape front-back direction. Particularly, since the back tape surface side is thinner in thickness than the front tape surface side, when lateral pulling force or pushing-up force is applied, the insert plate portion 67*a* is easily bent to curve in a shape protruding to the back tape surface side.

As a result, there occurs a phenomenon that the posture of the coupling portion 67*d* of the insert member 67 is obliquely inclined with respect to the tape front-back direction or the position of the coupling portion 67*d* shifts backward, leading to a problem in that engagement between the coupling portion 67*d* and the continuous fastener element of the other coupling party is easily disengaged and the element rows of the slide fastener are easily decoupled starting from the end portion at the separable bottom end stop 62 side.

The invention is made in light of the above described conventional problems, and a specific object of the invention is to provide a slide fastener with a separable bottom end stop in which an element row is formed by coil- or zigzag-shaped continuous fastener elements, a bottom end stop is capable of engaging an insert member with a pivot stopper body by two ways of operations, and a coupling state of the element rows is stably maintained even if the separable bottom end stop receives lateral pulling force or pushing-up force.

Means for Solving the Problem

In order to achieve the above object, the invention provides a slide fastener with a separable bottom end stop, including: a slider that passes through element rows each including coil- or zigzag-shaped continuous fastener elements fixed to opposing tape side edge portions of a pair of left and right fastener tapes; an insert member fixed to an end of one element row; and a pivot support member fixed to an end of the other element row, being characterized in that the insert member includes an insert plate portion of a thin plate form that is fixed to front and back tape surfaces of the fastener tape and has first and second surfaces, and a pivot shaft portion disposed to protrude on an end portion of the insert plate portion at a side opposite to the element row, the pivot support member includes first and second surfaces and includes a box pin portion that extends from an end of the element row to a tape end portion side in a tape length direction and holds the slider and a box portion that extends from the box pin portion, the box portion having a nearly J shape that allows the pivot shaft portion to be engageable and disengageable from a side of the pivot support member and to be engageable and disengageable through an element guide passage formed inside the slider, the pivot shaft portion is disposed to protrude only on the first surface of the insert plate portion, and the pivot support member includes a protrusion that extends toward a tape outer side from the first surface side of the box pin portion and supports the first surface side of the insert plate portion at the time of coupling of the element rows and a flat plate-like support portion that extends toward the tape outer side from the second surface side of the box portion and supports the second surface side of the insert plate portion at the time of coupling of the element rows.

In the slide fastener with the separable bottom end stop according to the invention, it is preferable that the box portion extend from the box pin portion via a step portion, and that the flat plate-like support portion be disposed closer to the box portion side further than the position of the step portion and closer to the element row side further than the pivot shaft portion engaged with the pivot support member in the tape length direction and disposed closer to an inner side further than the position of an outer wall surface of the box portion at the pivot support member side and closer to the tape outer side further than the pivot shaft portion engaged with the pivot support member in the tape width direction.

Furthermore, it is preferable that the insert member include a coupling portion, which is coupled with the continuous fastener element of the other coupling party, at a base end portion of the insert plate portion at the element row side, that the element row be sewed in a state in which a core thread is inserted into the continuous fastener element, and that an end of the core thread be buried inside the coupling portion.

In this case, it is preferable that the coupling portion include a projection protruding toward the element row, and that the protrusion be formed close to the first surface side of the insert plate portion.

Furthermore, it is preferable that the flat plate-like support portion support an end portion area including a second surface side of an end portion where the pivot shaft portion of the insert plate portion is formed.

Effect of the Invention

A slide fastener with a separable bottom end stop according to the invention includes left and right element rows that are formed by coil- or zigzag-shaped continuous fastener elements, an insert member fixed to an end of one element row, and a pivot support member fixed to an end of the other element row.

In this case, the insert member includes an insert plate portion of a thin plate form that is fixed to front and back tape surfaces of a fastener tape and has first and second surfaces and a pivot shaft portion disposed to protrude only on the first surface of the insert plate portion. The pivot support member has first and second surfaces and includes a box pin portion that extends from an end of the element row to a tape end portion side in a tape length direction and holds the slider, a box portion having a nearly J shape that extends from the box pin portion, a protrusion that extends toward a tape outer side from a first surface side of the box pin portion in parallel to the insert plate portion, and a flat plate-like support portion that extends toward the tape outer side from a second surface side of the box portion in parallel to the insert plate portion.

The slide fastener with the separable bottom end stop according to the invention is excellent in flexibility since the element rows are formed by the coil- or zigzag-shaped continuous fastener elements. Further, in the slide fastener, since the pivot shaft portion is disposed to protrude only on the first surface of the insert plate portion, even though the flat plate-like support portion is disposed at the second surface side of the box portion of the pivot support member, the flat plate-like support portion can be prevented from interfering with the insert member when the insert member is engaged with the pivot support member.

Further, in the slide fastener, when engaging the insert member with the pivot support member and coupling the left and right element rows, the first surface side of the insert member is supported by the protrusion of the pivot support member, and the second surface side of the insert plate portion is supported by the flat plate-like support portion. As a result, when the separable bottom end stop including the insert member and the pivot support member receives lateral pulling force in the tape width direction or pushing-up force in the tape front-back direction, the protrusion of the pivot support member supports the first surface side of the insert plate portion, so that the insert plate portion can be prevented from being bent to curve in a shape protruding to the front tape surface side. Further, the flat plate-like support portion of the pivot support member supports the second surface side of the insert plate portion, so that the insert plate portion can be prevented from being bent to curve in a shape protruding to the back tape surface side.

Thus, even if the separable bottom end stop receives lateral pulling force or pushing-up force, since the insert plate portion is prevented from being bent to curve, a relative position relationship between the insert member and the pivot support member can be stably maintained. Thus, the element rows are prevented from being decoupled from the end portion at the separable bottom end stop side, so that the coupling state of the element rows can be stably maintained.

In the slide fastener with the separable bottom end stop according to the invention, the box portion extends from the box pin portion via a step portion, and the flat plate-like support portion is disposed closer to the box portion side further than the position of the step portion and closer to the element row side further than the pivot shaft portion engaged with the pivot support member in the tape length direction and disposed closer to an inner side further than the position of an outer wall surface of the box portion at the pivot support member side and closer to the tape outer side further than the pivot shaft portion engaged with the pivot support member in the tape width direction.

In the slide fastener with the separable bottom end stop according to the invention, the insert member includes a coupling portion, which is coupled with the continuous fastener element of the other coupling party, at a base end portion of the insert plate portion at the element row side, the element row. is sewed in a state in which a core thread is inserted into the continuous fastener element, and an end of the core thread is buried inside the coupling portion.

That is, in the slide fastener with the separable bottom end stop according to the invention, an end of the core thread inserted into the continuous fastener element is buried inside the coupling portion of the insert member, and the core thread remains excised in the insert plate portion. As a result, the continuous fastener element can be stably attached to the fastener tape, and the insert plate portion can be more thinly formed. Thus, an operation of inserting the insert plate portion into the tape groove of the slider can be smoothly and stably performed.

In this case, the coupling portion includes a projection protruding toward the element row, and the projection is formed close to the first surface side of the insert plate portion. As a result, the projection disposed in the coupling portion can be easily engaged with the element row at the side where the pivot support member is formed, and thus the coupling strength of the left and right element rows can be improved.

Further, in the slide fastener with the separable bottom end stop according to the invention, when engaging the insert member with the pivot support member and coupling the left and right element rows, the flat plate-like support portion supports an end portion area including a second surface side of an end portion where the pivot shaft portion of the insert plate portion is formed. As a result, the flat plate-like support portion can more stably support the second surface side of the insert plate portion, thereby preventing the insert plate portion from being bent with a high degree of certainty.

EXPLANATIONS OF LETTERS AND NUMERALS

Figure 1:
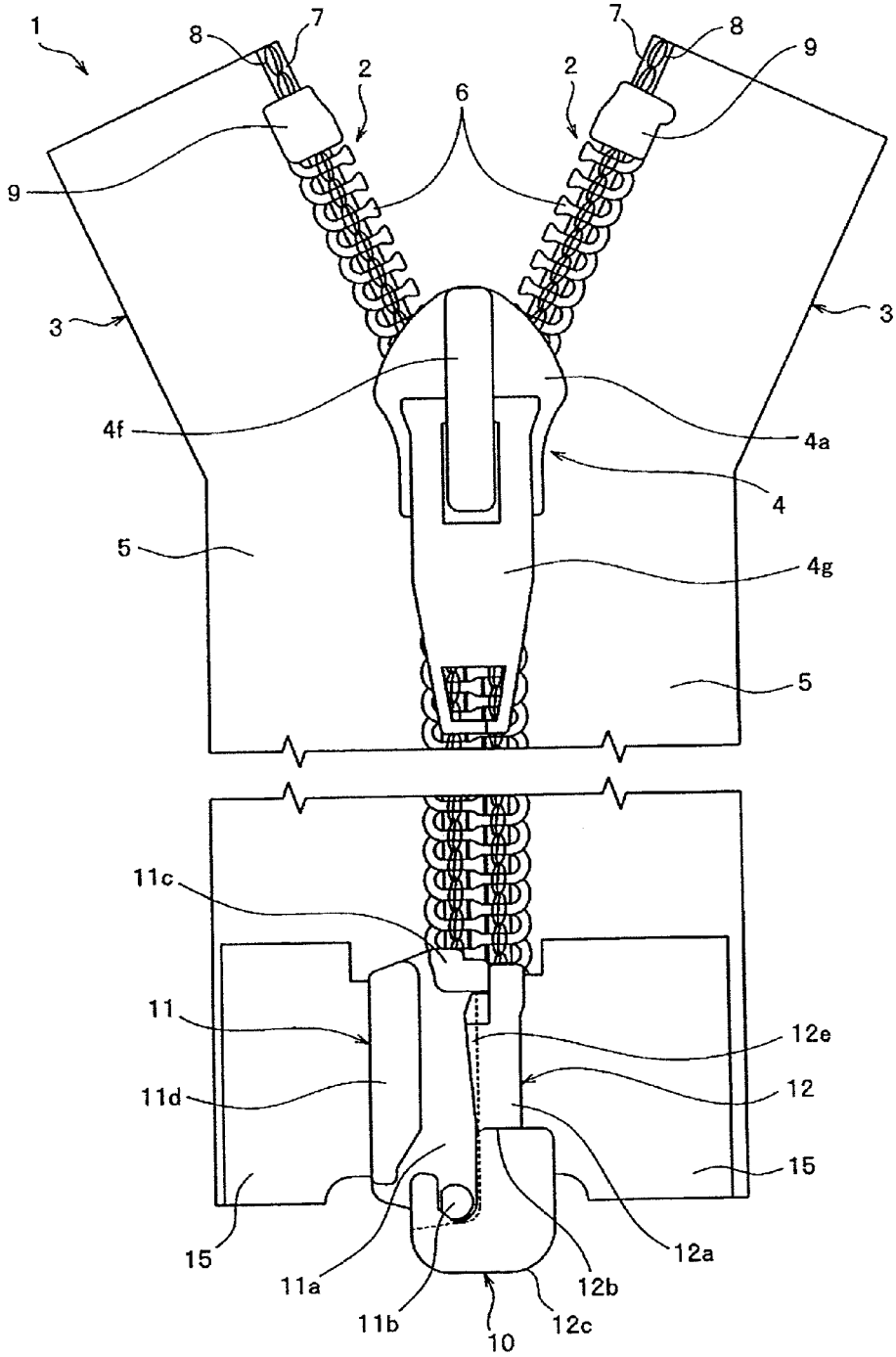
FIG. 1 is a front view illustrating a slide fastener with a separable bottom end stop according to a first embodiment of the invention.

1 slide fastener
2 element row
3 fastener stringer
4 slider
4*a* upper blade
4*b* lower blade
4*c* connecting post
4*d* upper and lower flanges
4*e* locking pawl
4*f* tab attaching post
4*g* tab
4*h* element guide passage
5 fastener tape
6 fastener element
6*a* first fastener element
7 core thread
8 sewing thread
9 top stop
10 separable bottom end stop
11 insert member
11*a* insert plate
11*b* pivot shaft portion
11*c* coupling portion
11*d* first projecting portion
11*e* second projecting portion
11*f* escape portion
11*g* step surface
11*h* projection
11*i* concave portion
11*k* cylindrical surface
11*m* first flat surface
11*n* second flat surface
12 pivot support member
12*a* box pin portion
12*b* first step portion
12*c* box portion
12*d* second step portion
12*e* protrusion
12*f* flat plate-like support portion
12*g* slope portion
12*h* concave portion
12*i* space portion
12*j* inner wall surface
12*k* slit
12*m* first sliding surface
12*n* second sliding surface
15 reinforcement portion
21 slide fastener
22 pivot support member
22*f* flat plate-like support portion

BEST MODE FOR CARRYING OUT THE INVENTION

Hereinafter, embodiments of the invention will be described in detail with reference to the embodiments and accompanying drawings. The invention is not limited to the following embodiments, and various changes can be made as long as substantially the same configuration and the same function effect as in the invention are provided.

For example, in slide fasteners with a separable bottom end stop which will be described in the following embodiments, element rows are formed by sewing coil-shaped continuous fastener elements to tape side edge portions of left and right fastener tapes, but the invention is not limited thereto. The element rows may be formed by sewing zigzag-shaped continuous fastener elements to tape side edge portions of fastener tapes.

First Embodiment

Figure 2:
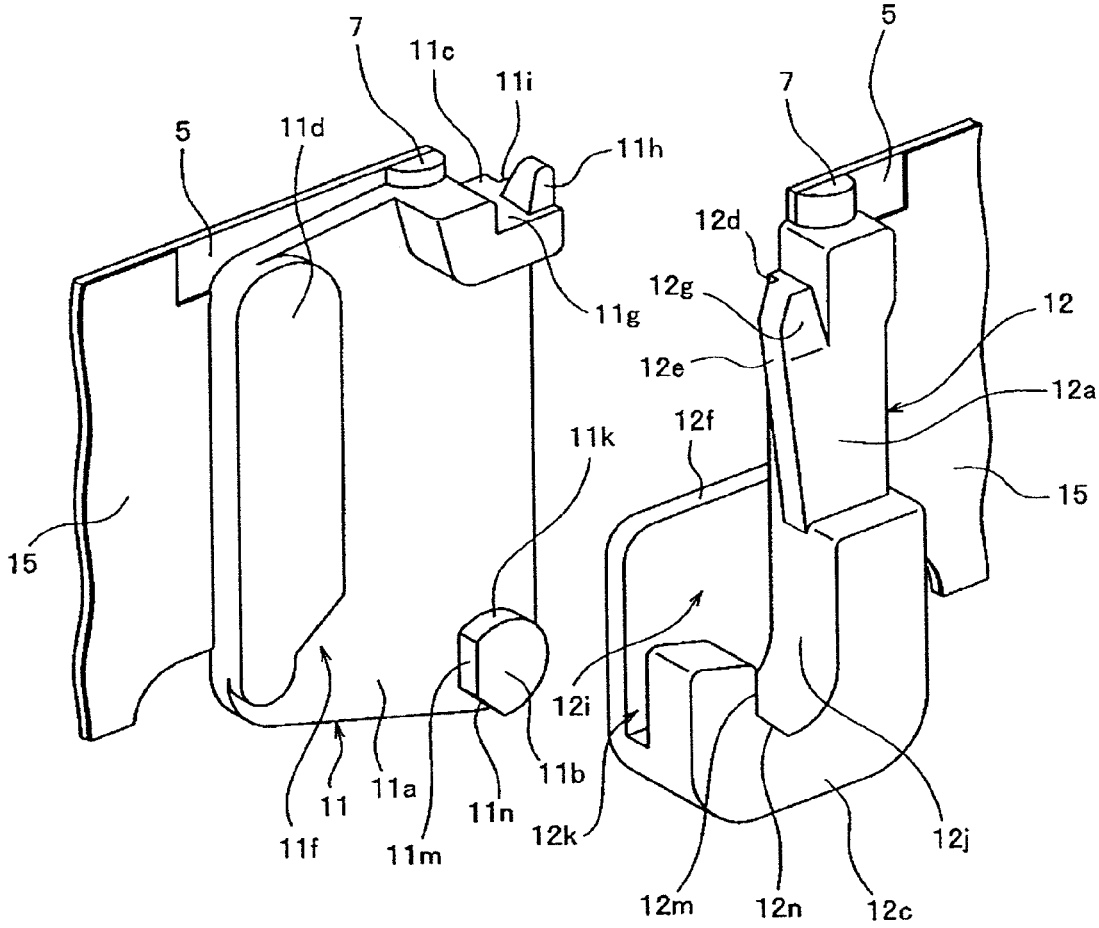
FIG. 2 is a perspective view illustrating an insert member and a pivot support member of a separable bottom end stop disposed in the slide fastener.
Figure 3:
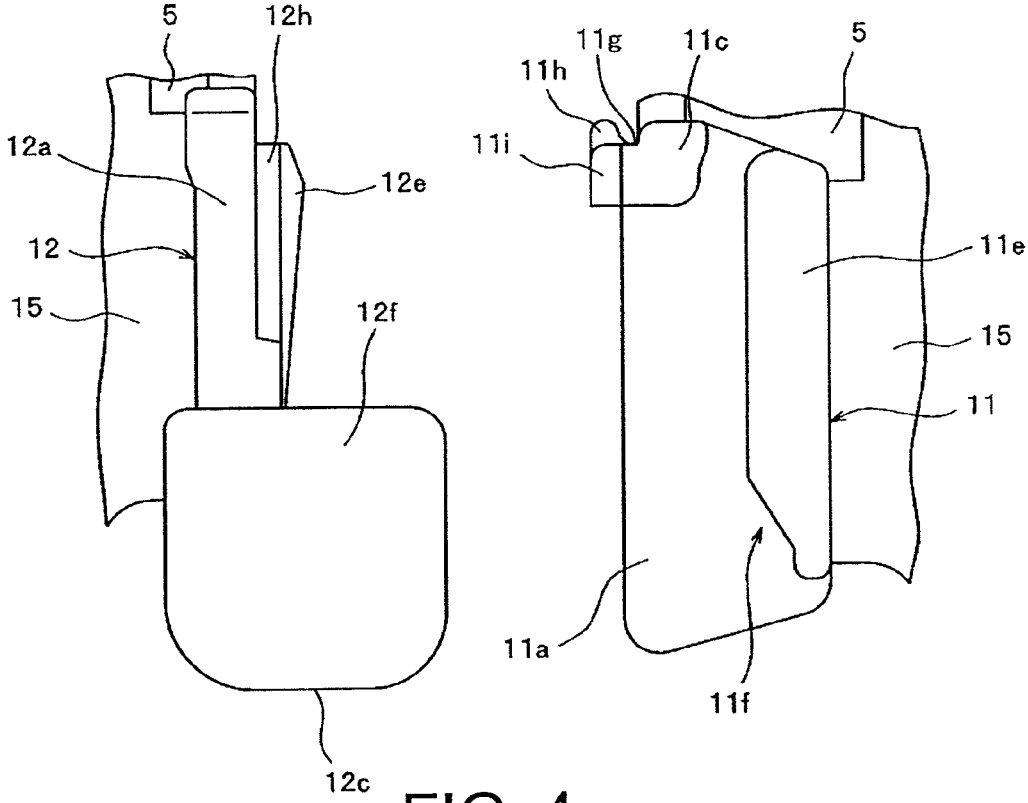
FIG. 3 is a back view illustrating the insert member and the pivot support member of the separable bottom end stop.

FIG. 1 is a front view illustrating a slide fastener with a separable bottom end stop according to the present first embodiment. FIG. 2 is a perspective view illustrating an insert member and a pivot support member of a separable bottom end stop disposed in the slide fastener, and FIG. 3 is a back view illustrating the insert member and the pivot support member of the separable bottom end stop.

Figure 4:
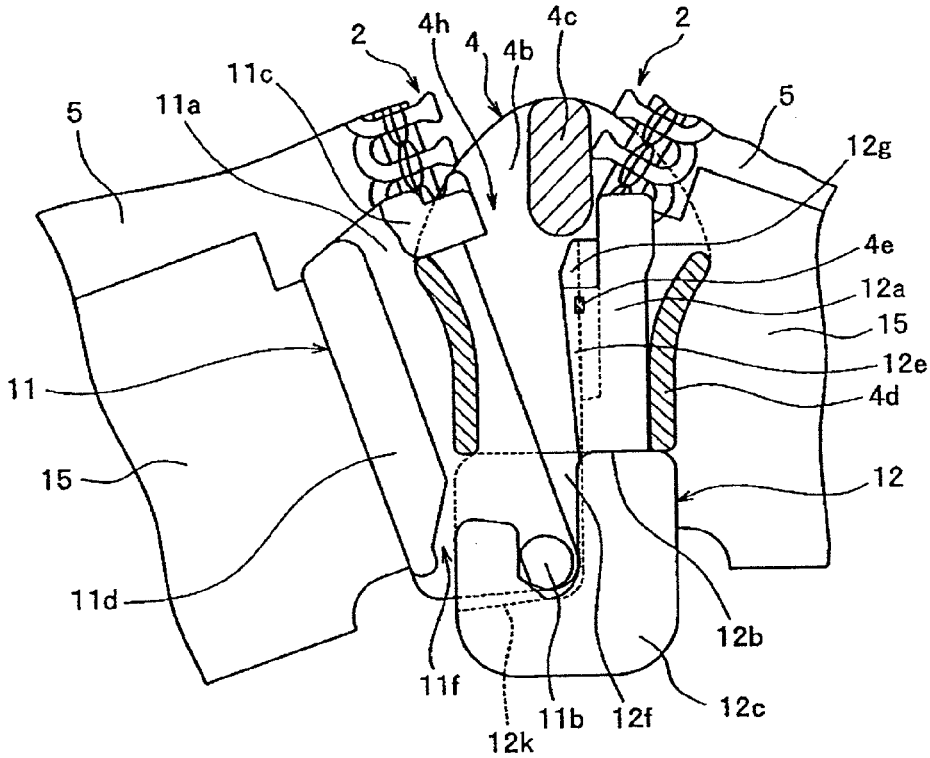
FIG. 4 is a cross-sectional view illustrating a state in which a pivot shaft portion of an insert member is engaged with a pivot support member.
Figure 5:
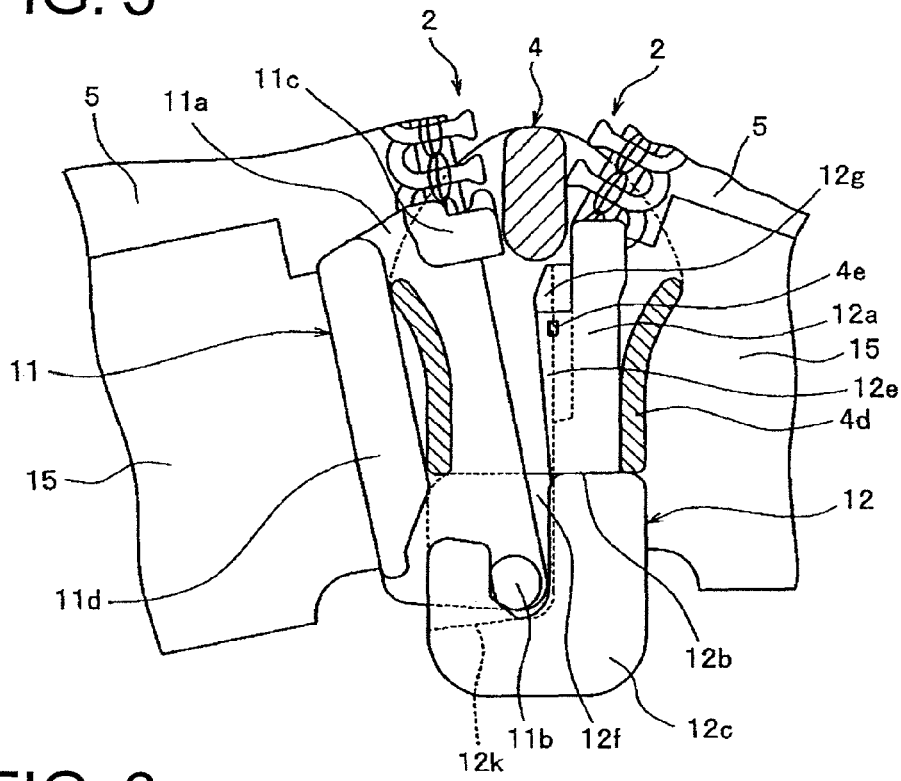
FIG. 5 is a cross-sectional view illustrating a state in which an insert member is engaged with a pivot support member, and an insert plate portion of the insert member is inserted into a tape groove of a slider.
Figure 6:
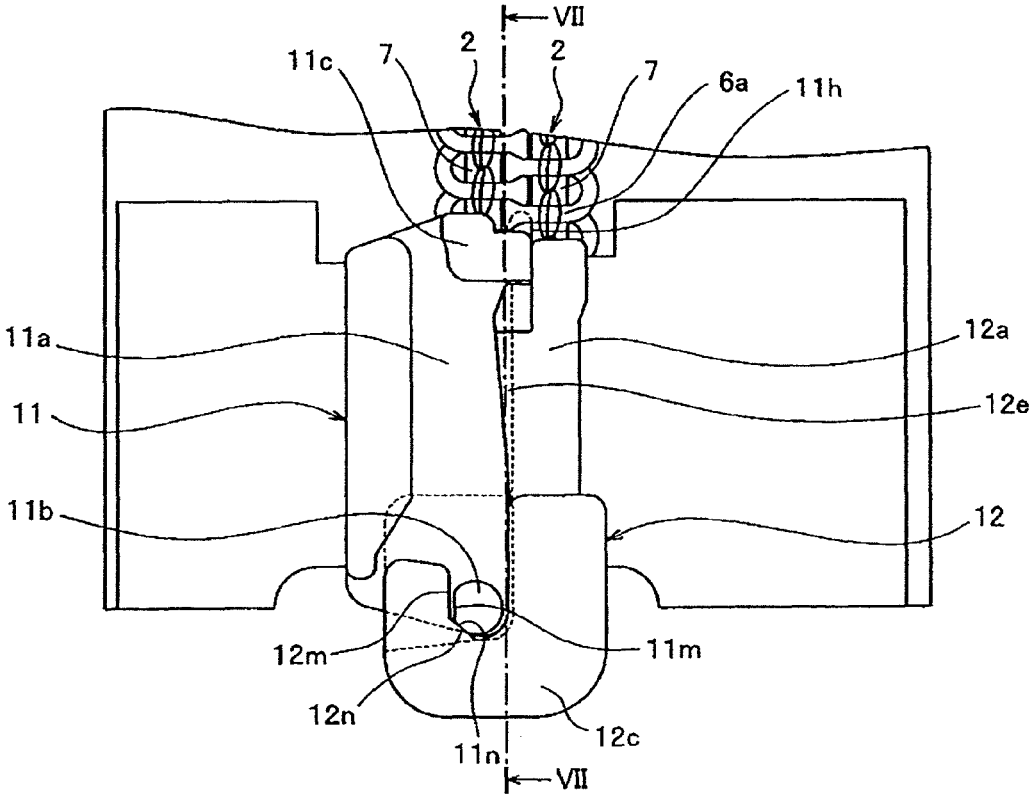
FIG. 6 is a front view illustrating a state in which left and right element rows are coupled.

Further, FIG. 4 is a cross-sectional view illustrating a state in which a pivot shaft portion of the insert member is engaged with the pivot support member, FIG. 5 is a cross-sectional view illustrating a state in which the insert member is engaged with the pivot support member, and an insert plate portion of the insert member is inserted into a tape groove of a slider, and FIG. 6 is a front view illustrating a state in which left and right element rows are coupled. In FIGS. 4 to 6, in order to illustrate the state of the slide fastener to be easily understood, a sewing thread for sewing continuous fastener elements to a fastener tape is not illustrated.

In the present first embodiment and a second embodiment which will be described later, the following description is made under the assumption that a tape length direction of the fastener tape is a front-rear direction (the side at which a top stop is disposed is the front side, and the side at which a separable bottom end stop is disposed is the rear side), a tape width direction is a horizontal direction (the left portion when viewed from the front surface is the left side, and the right portion is the right side), a tape front-back direction is a vertical direction (the side at which continuous fastener elements are disposed on the fastener tape is the upper side, and the side opposite thereto is the lower side).

A slide fastener 1 with a separable bottom end stop according to the present first embodiment includes a pair of left and right fastener stringers 3 on which element rows 2 are formed, a separable bottom end stop 10 attached to one end of the element rows 2 of the fastener stringers 3, and a slider 4 that couples or decouples the left and right element rows 2.

The fastener stringers 3 of the present first embodiment are formed by sewing coil-shaped continuous fastener elements 6 to upper surface sides of opposing tape side edge portions of left and right fastener tapes 5. The element rows 2 of the left and right fastener stringers 3 are formed by sewing the continuous fastener elements 6 to the upper surfaces of the fastener tapes 5 using a sewing thread 8 in the state in which a core thread 7 is inserted into the coil-shaped continuous fastener elements 6.

Further, the core thread 7 inserted into the right continuous fastener elements 6 extends more downward than the lower end of the right element row 2 and is buried inside a pivot support member 12 of the separable bottom end stop 10 which will be described later. Meanwhile, the core thread 7 inserted into the left continuous fastener elements 6 is disposed up to the position of a coupling portion 11*c* of the insert member 11 of the separable bottom end stop 10 which will be described later, and the rear end of the core thread 7 is buried inside the coupling portion 11*c*. Thus, the core thread 7 remains excised in an area of an insert plate portion 11*a* of the insert member 11 which will be described later, and the core thread 7 is not disposed inside the insert plate portion 11*a*.

The coil-shaped continuous fastener element 6 is obtained by forming a synthetic resin monofilament in a coil shape. The fastener element 6 includes a coupling head that is coupled with or decoupled from the fastener element 6 of the other party, a pair of upper and lower leg portions that extend from the coupling head in one direction (to the tape inner side), and a connecting portion that connects the leg portions of neighboring elements with each other. Here, a leg portion disposed at the upper side is referred to as an upper leg portion, and a leg portion disposed at the lower side is referred to as a lower leg portion. Since the element row 2 is formed by the coil-shaped fastener elements 6, the flexibility of the element row can be easily secured.

Further, top stops 9 are fixed to upper end portions of the left and right element rows 2, respectively. Further, reinforcement portions 15 are formed on the front and back surfaces of the lower end portions of the fastener tapes 5 in the tape length direction by adhering a synthetic resin film.

As the slider 4, the same one as the typical slider 4 used in the conventional slide fastener 1 having the coil-shaped continuous fastener element 6 is used. The slider 4 includes upper and lower blades 4*a* and 4*b*, a connecting post 4*c* that connects the upper and lower blades 4*a* and 4*b* at a front end portion of the slider 4, upper and lower flanges 4*d* disposed at the left and right side edges of the upper and lower blades 4*a* and 4*b*, a locking pawl 4*e* that is disposed on the upper blade 4*a* and capable of stopping the slider 4 by engaging with the element row 2, a tab attaching post 4*f* erected on the front surface of the upper blade 4*a*, and a tab 4*g* attached to the tab attaching post 4*f*.

Further, on an end portion (a front end portion) where the connecting post 4*c* of the slider 4 is disposed, shoulder mouths are formed on the left and right of the connecting post 4*c*, and a rear mouth is formed on an end portion (a rear end portion) at the opposite side. An element guide passage 4*h* that allows the left and right shoulder mouths to communicate with the rear mouth and has a nearly Y shape in a front view is disposed in the slider 4. A partition (not shown) for stabilizing the position of the fastener element 6 passing through the element guide passage 4*h* is formed inside the element guide passage 4*h*. The partition is configured with a projecting portion formed on the surfaces (the inner surfaces) of the upper and lower blades 4*a* and 4*b* at the element guide passage 4*h* side.

Further, tape grooves that allow the fastener tapes 5 to pass through when the slider 4 slides along the element rows 2 are disposed between the upper and lower flanges 4*d* of the slider 4, and the left and right tape grooves of the slider 4 are set closer to the lower blade 4*b* side further than the intermediate position between the upper and lower blades 4*a* and 4*b* in the vertical direction (the height direction).

That is, since the element rows 2 of the left and right fastener stringers 3 are disposed only on the upper surface sides of the fastener tapes 5, by disposing the tape grooves of the slider 4 near the lower blade 4*b*, a gap between the lower blade 4*b* of the slider 4 and the lower tape surface of the fastener tape 5 can decrease when the slider 4 slides to couple or decouple the left and right element rows 2. As a result, the continuous fastener element 6 is prevented from tilting (turning) inside the element guide passage 4*h* of the slider 4 in a direction orthogonal to the tape length direction, and thus the posture of the continuous fastener element 6 can be stabilized. Accordingly, coupling or decoupling of the left and right element rows 2 can be smoothly performed.

The separable bottom end stop 10 of the present first embodiment is integrally formed at the lower end portion of the fastener tape 5 by injection-molding thermoplastic resin such as polyacetal or polyamide on the fastener tape 5. The bottom end stop 10 includes the insert member 11 disposed at the tape side edge portion of the left fastener tape 5 and the pivot support member 12 disposed at the tape side edge portion of the right fastener tape 5.

The insert member 11 of the separable bottom end stop 10 continues from the lower end edge of the left element row 2 and is formed to sandwich the front and back tape surfaces of the fastener tape 5. The insert member 11 includes an insert plate portion 11*a* of a thin plate form fixed to the front and back tape surfaces of the fastener tape 5, a pivot shaft portion

11*b* disposed to protrude at an angular portion of the insert plate portion 11*a* at the rear end side, a coupling portion 11*c* disposed on a base end portion (a front end portion) of the insert plate portion 11*a* at the element row 2 side, and first and second projecting portions 11*d* and 11*e* respectively formed along tape inner side edge portions of the front and back surfaces of the insert plate portion 11*a*. In this case, the front surface (the upper surface) of the insert plate portion 11*a* is referred to as a first surface, and the back surface (the lower surface) is referred to as a second surface.

The insert plate portion 11*a* of the insert member 11 has the front and back surfaces formed in a flat thin plate form, and the thickness of the insert plate portion 11*a* is set to be smaller than the size of the groove width of the tape groove of the slider 4 (the gap between the upper and lower flanges 4*d*) and also set to be smaller than a dimension of the element row 2 in the vertical direction.

Particularly, in the present first embodiment, the core thread 7 is not disposed in the insert plate portion 11*a* as described above. For this reason, the thickness of the insert plate portion 11*a* can become easily thinner than the groove width of the tape groove, and since the insert plate portion 11*a* is not divided by the core thread 7, the strength or stiffness of the insert plate portion 11*a* can increase. Further, the core thread 7 gets stuck into the inside of the coupling portion 11*c*.

The insert plate portion 11*a* is inserted into the element guide passage 4*h* through the tape groove disposed close to the lower blade 4*b* of the slider 4 as will be described later when pivot-supporting the pivot shaft portion 11*b* of the insert member 11 to the pivot stopper body 12. Thus, the lower surface portion of the insert plate portion 11*a* disposed at the lower tape surface side is thinner in thickness than the upper surface portion disposed at the upper tape surface side.

Figure 10:
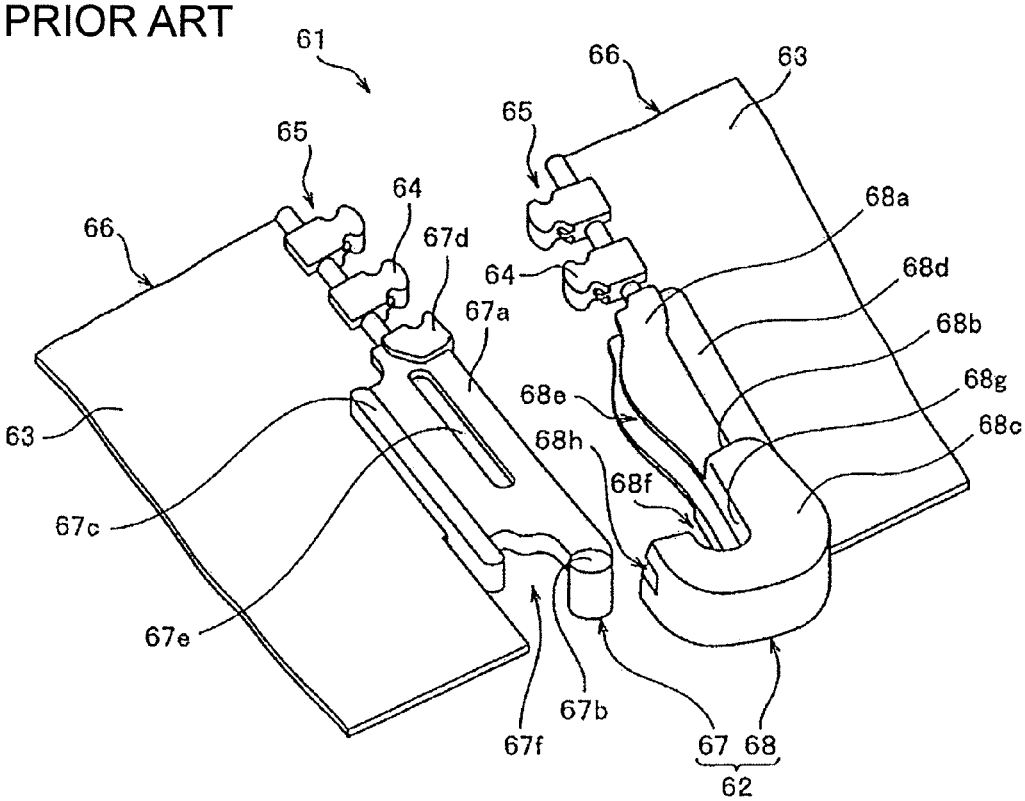
FIG. 10 PRIOR ART
FIG. 10 is a perspective view illustrating a conventional slide fastener with a separable bottom end stop.

The pivot shaft portion 11*b* of the insert member 11 is disposed at the angular portion of the tape outer side (the pivot support member opposing side edge side) at the rear end side of the insert plate portion 11*a* (the upper surface of the insert plate portion 11*a* and the end portion side opposite to the element row 2 side) and is disposed to protrude only on the upper surface of the insert plate portion 11*a*, for example, unlike the to-be-pivoted portion 67*b* (the pivot shaft portion) (see FIG. 10) that is disposed to protrude on both of the upper and lower surfaces of the insert plate portion 11*a* as in Patent Document 1. In this case, a height dimension (the thickness) in the tape front-back direction from the lower surface of the insert plate portion 11*a* to the upper surface of the pivot shaft portion 11*b* is set to be smaller than the gap between the upper and lower blades 4*a* and 4*b* of the slider 4 and larger than the tape groove of the slider 4.

The pivot shaft portion 11*b* is formed in a nearly cylindrical shape, but a side wall surface of the pivot shaft portion 11*b* is formed by a cylindrical surface 11*k*, a first flat surface 11*m* that is disposed at the tape inner side of the pivot shaft portion 11*b* and in parallel to the tape length direction, and a second flat surface 11*n* that curves from the first flat surface 11*m* and is inclined so that a dimension of the pivot shaft portion 11*b* in the tape width direction gradually decreases backward.

The first and second projecting portions 11*d* and 11*e* of the insert member 11 are formed along the tape inner side edges of the insert plate portion 11*a*, protruding from the front surface and the back surface of the insert plate portion 11*a*, respectively. By forming the first and second projecting portions 11*d* and 11*e*, it is possible to increase the stiffness of the insert plate portion 11*a*.

In the lower end portion of the first projecting portion 11*d* disposed on the front surface of the insert plate portion 11*a* and the lower end portion of the second projecting portion 11*e* disposed on the back surface of the insert plate portion 11*a*, escape portions 11*f* are disposed at the insert plate portion 11*a* side to be cut out toward the tape inner side from the side surface, and a width dimension (a dimension in the tape width direction) of the rear end portions of the first and second projecting portions 11*d* and 11*e* is smaller than a width dimension of the front end portions thereof.

Further, the escape portion 11*f* disposed in the second projecting portion 11*e* is formed to be larger in tape length direction than the escape portion 11*f* disposed in the first projecting portion 11*d*, and the front end position of the escape portion 11*f* disposed in the second projecting portion 11*e* is disposed closer to an element row side (a front side) further than the front end of the escape portion 11*f* disposed in the first projecting portion 11*d*. By disposing the escape portions 11*f* in the first and second projecting portions 11*d* and 11*e*, as will be described later, when the pivot shaft portion 11*b* of the insert member 11 is pivot-supported on the pivot support member 12, or when the insert member 11 rotates on the pivot shaft portion 11*b* engaged with the pivot support member 12 toward the pivot support member 12 side, the first and second projecting portions 11*d* and 11*e* are prevented from interfering with a box portion 12*c* and a flat plate-like support portion 12*f* of the pivot support portion 12 which will be described later.

The coupling portion 11*c* of the insert member 11 sandwiches the front and back tape surfaces of the fastener tape 5 and is formed integrally with the insert plate portion 11*a*. Even in the coupling portion 11*c*, similarly to the insert plate portion 11*a*, a portion of the coupling portion 11*c* disposed at the lower tape surface side is set to be thinner in thickness than a portion disposed at the upper tape surface side.

Figure 7:
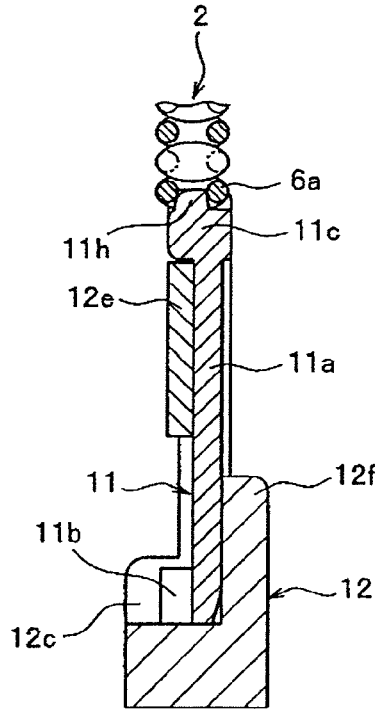
FIG. 7 is a cross-sectional view taken along line VII-VII of FIG. 6.

The coupling portion 11*c* includes a step surface 11*g* on which the fastener element 6 of the other coupling party can be placed when the left and right element rows 2 are coupled, a projection 11*h* of a truncated quadrangular pyramid shape protruding forward (toward the element row) from the step surface 11*g*, and a concave portion 11*i* that is recessed along the pivot support member opposing side edge of the coupling portion 11*c* at the lower surface side. In the present first embodiment, as illustrated in FIG. 7, the projection 11*h* of the coupling portion 11*c* is formed to be biased closer to the upper surface side (the first surface side) of the insert plate portion 11*a* of the thin plate form.

Since the projection 11*h* is formed in the coupling portion 11*c* as described above, when coupling the left and right element rows 2, the projection 11*h* can be stably inserted into between the upper and lower leg portions of the fastener element 6 of the other coupling party placed on the step surface 11*g*, and the coupling portion 11*c* can be easily engaged with the fastener element 6. Accordingly, the coupling strength of the separable bottom end stop 10 side end portions of the left and right element rows 2 can increase.

Further, since the concave portion 11*i* is formed in the coupling portion 11*c*, it can be avoided that the coupling portion 11*c* of the insert member 11 interferes with the partition disposed inside the element guide passage 4*h* of the slider 4, for example, when the insert plate portion 11*a* of the insert member 11 is inserted into the slider 4 after the slider 4 is held on a box pin portion 12*a* of the pivot support member 12 which will be described later.

In the present first embodiment, the pivot support member 12 of the separable bottom end stop 10 continues from the lower end edge of the right element row 2 and is formed to sandwich the front and back tape surfaces of the fastener tape 5. The pivot support member 12 includes the box pin portion 12*a* formed to sandwich the front and back surfaces of the right fastener tape 5, a box portion 12*c* that is formed at a thickness thicker than the box pin portion 12*a* from the rear end of the box pin portion 12*a* via a first step portion 12*b* and has a nearly J shape in a front view, a protrusion 12*e* that extends toward the tape outer side from the first surface side (the upper surface side) of the box pin portion 12*a* through a second step portion 12*d* at a thickness thinner than the box pin portion 12*a*, and a flat plate-like support portion 12*f* that extends to the second surface side (the lower surface side) of the box portion 12*c*.

The box pin portion 12*a* of the pivot support member 12 has a height dimension (the thickness) in the tape front-back direction that is set to be larger than the groove width of the tape groove of the slider 4 (the gap between the upper and lower flanges 4*d*) and smaller than a height dimension of the element guide passage 4*h* of the slider 4 (the gap between the upper and lower blades 4*a* and 4*b*). The box pin portion 12*a* is formed to be inserted into the element guide passage 4*h* of the slider 4 and hold the slider 4 when the slider 4 slides along the element rows 2 up to the position where the slider 4 abuts on the first step portion 12*b* of the pivot support member 12.

Further, in order to avoid that the partition (not shown) of the slider 4 interferes with the box pin portion 12*a* and the protrusion 12*e* when the slider 4 is held on the box pin portion 12*a*, a slope portion 12*g* that is inclined toward its front end edge is formed at the upper surface side of the box pin portion 12*a* and the protrusion 12*e* (see FIG. 2). Further, a concave portion 12*h* is formed, at an insert member opposing side edge of the box pin portion 12*a* at the lower surface side, to be recessed along the tape length direction.

The box portion 12*c* of the pivot support member 12 extends from the box pin portion 12*a* to the tape end edge portion and has a nearly J shape in the front view that is formed to curve toward the insert member 11 side from the tape end edge portion and allows the pivot shaft portion 11*b* of the insert member 11 to be engaged or disengaged through the side of the pivot support member 12. In this case, the box portion 12*c* includes a space portion 12*i* formed to receive the pivot shaft portion 11*b* of the insert member 11 from the side of the pivot support member 12 when the slider 4 is held on the box pin portion 12*a* and an inner wall surface 12*j* that rotatably engages the pivot shaft portion 11*b* inserted through the space portion 12*i*.

The inner wall surface 12*j* of the box portion 12*c* includes a first sliding surface 12*m* that slidingly contacts on the first flat surface 11*m* of the pivot shaft portion 11*b* when the pivot shaft portion 11*b* is pivot-supported and a second sliding surface 12*n* that slidingly contacts the second flat surface 11*n* of the pivot shaft portion 11*b*. In this case, the first sliding surface 12*m* is disposed in parallel to the tape length direction. The second sliding surface 12*n* is formed to curve from the first sliding surface 12*m* and to be inclined with respect to the tape length direction.

Further, a slit 12*k* having the groove width larger than the thickness of the insert plate portion 11*a* is formed on a leading end portion of the box portion 12*c* at the curved side to allow the insert plate portion 11*a* of the insert member 11 to be inserted into. The slit 12*k* is disposed at the lower surface side of the box portion 12*c* so that the slit 12*k* can be penetrated from the outer wall surface to the inner wall surface 12*j* of the box portion 12*c*, and a portion of the inner wall surface 12*j* below the slit 12*k* is formed by the upper surface of the flat plate-like support portion 12*f*.

The protrusion 12*e* of the pivot support member 12 extends toward the tape outer side from the insert member opposing side edge of the box pin portion 12*a* to the upper surface side of the box pin portion 12*a* via the second step portion 12*d* in parallel to the upper tape surface and the lower tape surface of the fastener tape 5 at a thickness thinner than the box pin portion 12*a*. In this case, the second step portion 12*d* is formed along the tape length direction.

The protrusion 12*e* is disposed behind the position of the coupling portion 11*c* of the insert member 11 and ahead of the box portion 12*c* of the pivot support member 12 in the tape length direction when the left and right element rows 2 are coupled. Further, when the element rows 2 are coupled, the protrusion 12*e* is superimposed on the insert plate portion 11*a* of the insert member 11 in the tape front-back direction, and the lower surface of the protrusion 12*e* can come in surface contact with the upper surface of the insert plate portion 11*a*.

The flat plate-like support portion 12*f* of the pivot support member 12 is formed at the lower surface side of the box portion 12*c* in parallel to the upper tape surface and the lower tape surface of the fastener tape 5. The flat plate-like support portion 12*f* is disposed closer to the rear side further than the position of the first step portion 12*b* (the end portion side of the box portion 12*c*) in the tape length direction and disposed closer to the inner side, which is the fastener tape 5 side, further than the position of the leading end portion outer wall surface of the box portion 12*c* in the tape width direction. Further, the flat plate-like support portion 12*f* is disposed closer to the element row 2 side further than the pivot shaft portion 11*b* and disposed to extend closer to the tape outer side further than the pivot shaft portion 11*b* when the pivot shaft portion 11*b* of the insert member 11 is engaged with the pivot support member 12. That is, the flat plate-like support portion 12*f* is formed to have a nearly rectangular shape when viewed from the front surface.

Further, in the present first embodiment, the front end surface of the flat plate-like support portion 12*f* is disposed in parallel to the tape width direction and is on the same plane surface as the stepped surface of the first step portion 12*b*. Further, the left side surface of the flat plate-like support portion 12*f* (the side surface opposite to the second projecting portion 11*e* of the insert member 11 when the insert member 11 is engaged with the pivot support member 12) is on the same plane surface as the leading end portion outer wall surface of the box portion 12*c*.

Next, an operation of closing the slide fastener 1 with the separable bottom end stop having the above described configuration according to the present first embodiment will be described.

First, by sliding the slider 4 toward the pivot support member 12 along the element row 2 disposed in the right fastener stringer 3, the rear mouth side end portion (the rear end portion) of the slider 4 abuts on the front end surfaces of the first step portion 12*b* and the flat plate-like support portion 12*f* of the pivot support member 12, and the slider 4 is held on the box pin portion 12*a*.

At this time, since the slope portion 12*g* is formed in the box pin portion 12*a* and the protrusion 12*e* of the pivot support member 12, when the slider 4 slides to abut on the front end surfaces of the first step portion 12*b* and the flat plate-like support portion 12*f*, the locking pawl 4*e* of the slider 4 can smoothly ride on the upper surfaces of the box pin portion 12*a* and the protrusion 12*e*. Further, since the slope portion 12*g* is formed, the box pin portion 12*a* and the protrusion 12*e* can be prevented from interfering with the partition of the slider 4. Further, since the front end surface of the flat plate-like support portion 12*f* is disposed in parallel to the tape width direction as described above, as the slider 4 abuts on the front end surface of the flat plate-like support portion 12*f*, the posture of the slider 4 can be straightly maintained in the tape length direction.

Subsequently, by having the pivot shaft portion 11*b* of the insert member 11 disposed in the left fastener stringer 3 abut on the inner wall surface 12*j* of the box portion 12*c* through the space portion 12*i* of the pivot support member 12, the pivot shaft portion 11*b* is pivot-supported on the box portion 12*c* (see FIG. 5). At this time, in the slide fastener 1 of the present first embodiment, an operation of pivot-supporting the pivot shaft portion 11*b* on the box portion 12*c* may be performed by arbitrarily selecting one of the following two kinds of methods.

First, as a first operation method, by guiding the pivot shaft portion 11*b* of the insert member 11 from the left side of the pivot support member 12 and inserting the pivot shaft portion 11*b* to the inner wall surface 12*j* of the box portion 12*c* through the space portion 12*i* between the box portion 12*c* and the slider 4, as illustrated in FIG. 4, the pivot shaft portion 11*b* can abut on the inner wall surface 12*j* of the box portion 12*c* and be pivot-supported on the box portion 12*c*.

At this time, in the slide fastener 1 of the present first embodiment, since the pivot shaft portion 11*b* is disposed to protrude only on the upper surface of the insert plate portion 11*a*, even though the flat plate-like support portion 12*f* extends to the lower surface side of the box portion 12*c*, the insert member 11 does not interfere with the flat plate-like support portion 12*f* when pivot-supporting the pivot shaft portion 11*b* on the box portion 12*c*.

Further, since the slit 12*k* is disposed in the leading end portion of the box portion 12*c*, when pivot-supporting the pivot shaft portion 11*b* on the box portion 12*c*, by inserting the insert plate portion 11*a* of the insert member 11 into the slit 12*k*, the insert plate portion 11*a* can be prevented from interfering with the box portion 12*c*. In this case, by having the lower surface of the insert plate portion 11*a* slidingly contact the upper surface of the flat plate-like support portion 12*f*, the pivot shaft portion 11*b* can be smoothly guided to and pivot-supported on the box portion 12*c*.

After the pivot shaft portion 11*b* is pivot-supported on the box portion 12*c*, by rotating the insert member 11 centering on the pivot shaft portion 11*b* toward the pivot support member 12, the insert plate portion 11*a* of the insert member 11 is inserted into the element guide passage 4*h* from the tape groove of the slider 4. At this time, the insert member 11 rotates until the insert plate portion 11*a* abuts on the connecting post 4*c* of the slider 4 or reaches the position near the connecting post 4*c*. As a result, a relative position relationship between the insert member 11 and the pivot support member 12 can be set to the state in which coupling of the element rows 2 can stably start as illustrated in FIG. 5.

Meanwhile, as a second operation method, by inserting the pivot shaft portion 11*b* of the insert member 11 into the space portion 12*i* of the pivot support member 12 from the left side shoulder mouth of the slider 4 via the element guide passage 4*h* and having the pivot shaft portion 11*b* abut on the inner wall surface 12*j* of the box portion 12*c*, the pivot shaft portion 11*b* can be pivot-supported on the box portion 12*c*. As a result, similarly to the above described first operation method, a relative position relationship between the insert member 11 and the pivot support member 12 can be set to the state in which coupling of the element rows 2 can stably start as illustrated in FIG. 4.

After the insert member 11 and the pivot support member 12 are held with a predetermined position relationship using the first operation method or the second operation method, the slider 4 slides forward, that is, in the element coupling direction. As a result, the projection 11*h* disposed in the coupling portion 11*c* of the insert member 11 is inserted into between the upper and lower leg portions of the right fastener element 6 adjacent to the pivot support member 12 (hereinafter, the fastener element 6 is referred to as a first fastener element 6*a*), the coupling portion 11*c* is engaged with the first fastener element 6*a*, and the left and right element rows 2 are coupled in order starting from the first fastener element 6*a*, whereby the slide fastener 1 can be easily closed.

The slide fastener 1 of the present first embodiment in which the left and right element rows 2 are coupled becomes the state in which the protrusion 12*e* of the pivot support member 12 is superimposed on the upper surface of the pivot support member opposing side edge portion of the insert plate portion 11*a* of the insert member 11 in the tape front-back direction, and the lower surface of the protrusion 12*e* comes in surface contact with the upper surface of the insert plate portion 11*a* as illustrated in FIGS. 6 and 7.

A rear end portion area including an opposite surface side (the second surface side) of the angular portion where the pivot shaft portion 11*b* of the insert plate portion 11*a* is disposed is supported from the lower surface side by the flat plate-like support portion 12*f* extending in parallel to the insert plate portion 11*a*. Further, since the rear end portion area is inserted into the slit 12*k* of the box portion 12*c*, a part of the rear end portion area is supported from the upper surface side by the leading end portion of the box portion 12*c*. The rear end portion area refers to an area, at the rear end side, that includes the lower surface side (the second surface side) of the angular portion where at least the pivot shaft portion 11*b* is disposed in the insert plate portion 11*a* and is directed toward the tape inner side from the angular portion.

That is, in the state in which the left and right element rows 2 are coupled, the thin plate-like insert plate portion 11*a* of the insert member 11 is supported from the vertical direction to be sandwiched by the protrusion 12*e* of the pivot support member 12, the flat plate-like support portion 12*f*, and the leading end portion of the box portion 12*c*. As a result, even if the separable bottom end stop 10 receives, for example, lateral pulling force in the tape width direction or pushing-up force in the tape front-back direction, the protrusion 12*e* of the pivot support member 12 is superimposed in a state facing the upper surface of the insert plate portion 11*a* to support the insert plate portion 11*a*, and the leading end portion of the box portion 12*c* supports the insert plate portion 11*a* from the upper surface side.

For this reason, even if the insert plate portion 11*a* tends to be bent to curve in a shape protruding toward the upper surface side, since the protrusion 12*e* comes in surface contact with the insert plate portion 11*a*, the insert plate portion 11*a* can be prevented from being deformed any more. Further, since the flat plate-like support portion 12*f* of the pivot support member 12 supports the second surface side of the insert plate portion 11*a*, even if the insert plate portion 11*a* tends to be bent to curve in a shape protruding toward the lower surface side, the insert plate portion 11*a* can be prevented from being deformed.

As described above, in the slide fastener 1 of the present first embodiment, even if the separable bottom end stop 10 receives lateral pulling force or pushing-up force, since the insert plate portion 11*a* can be prevented from being bent in the vertical direction, the relative position or posture of the coupling portion 11*c* disposed on the upper end portion of the insert plate portion 11*a* can be stably held. Accordingly, engagement between the coupling portion 11*c* and the first fastener element 6*a* at the right side can be stably maintained, and it is possible to prevent the element rows 2 from being decoupled from the end portion at the separable bottom end stop 10 side.

Further, in the slide fastener 1 of the present first embodiment, since the fastener elements 6 are sewed to the upper surface side of the fastener tape 5 and the tape groove of the slider 4 is formed close to the lower blade 4*b* as described above, the lower blade 4*b* is disposed, at a position closer to the tape surface of the fastener tape 5 than the upper blade 4*a*. Thus, the protrusion 12*e* protruding toward the tape outer side from the box pin portion 12*a* can be disposed on the upper surface side (the first surface) of the box pin portion 12*a* as described above, but a protrusion cannot be disposed on the lower surface (the second surface) side of the box pin portion 12*a* since a sufficient space does not remain between the lower blade 4*b* of the slider 4 and the tape surface of the fastener tape 5. That is, the protrusion extending from the box pin portion 12*a* can support the insert plate portion 11*a* from the upper surface side but cannot support the insert plate portion 11*a* from the lower surface side. In this case, the lower surface of the insert plate portion 11*a* is supported by the flat plate-like support portion 12*f* as described above. Thus, even if the separable bottom end stop 10 receives lateral pulling force or pushing-up force, the coupling state of the element rows 2 can be stably maintained.

Particularly, in the slide fastener 1 of the present first embodiment, when the left and right element rows 2 are in the coupling state, the first flat surface 11*m* of the pivot shaft portion 11*b* is spaced apart from the first sliding surface 12*m* of the box portion 12*c*, and the second flat surface 11*n* of the pivot shaft portion 11*b* comes in surface contact with the second sliding surface 12*n* of the box portion 12*c*. Thus, for example, when the separable bottom end stop 10 receives lateral pulling force, the pivot shaft portion 11*b* relatively moves diagonally to the upper left along the second sliding surface 12*n* of the box portion 12*c* so as to reduce the distance between the first flat surface 11*m* of the pivot shaft portion 11*b* and the first sliding surface 12*m* of the box portion 12*c*, and thus the insert member 11 moves to be pushed up forward with respect to the pivot support member 12.

As a result, since the projection 11*h* of the coupling portion 11*c* is more deeply inserted into between the upper and lower leg portions of the first fastener element 6*a*, the coupling portion 11*c* can be more firmly engaged with the first fastener element 6*a*. Thus, the slide fastener 1 of the present first embodiment can prevent the occurrence of decoupling with a high degree of certainty even if the separable bottom end stop 10 receives lateral pulling force.

Further, the separable bottom end stop 10 receives lateral pulling force, the pivot shaft portion 11*b* moves along the second sliding surface 12*n* of the box portion 12*c* as described above, and the first flat surface 11*m* of the pivot shaft portion 11*b* comes in surface contact with the first sliding surface 12*m* of the box portion 12*c*. Thus, the position of the pivot shaft portion 11*b* can be stably held, and it is possible to prevent the pivot shaft portion 11*b* from getting out of the box portion 12*c*.

Further, in the slide fastener 1 of the present first embodiment, in order to decouple the left and right element rows 2 and open the slide fastener 1, first by sliding the slider 4 toward the separable bottom end stop 10 along the element rows 2, the rear end portion of the slider 4 abuts on the front end surfaces of the first step portion 12*b* and the flat plate-like support portion 12*f* of the pivot support member 12, and the slider 4 is held on the box pin portion 12*a*. As a result, the left and right element rows 2 are decoupled, and engagement between the coupling portion 11*c* of the insert member 11 and the first fastener element 6*a* is also released.

Figure 8:
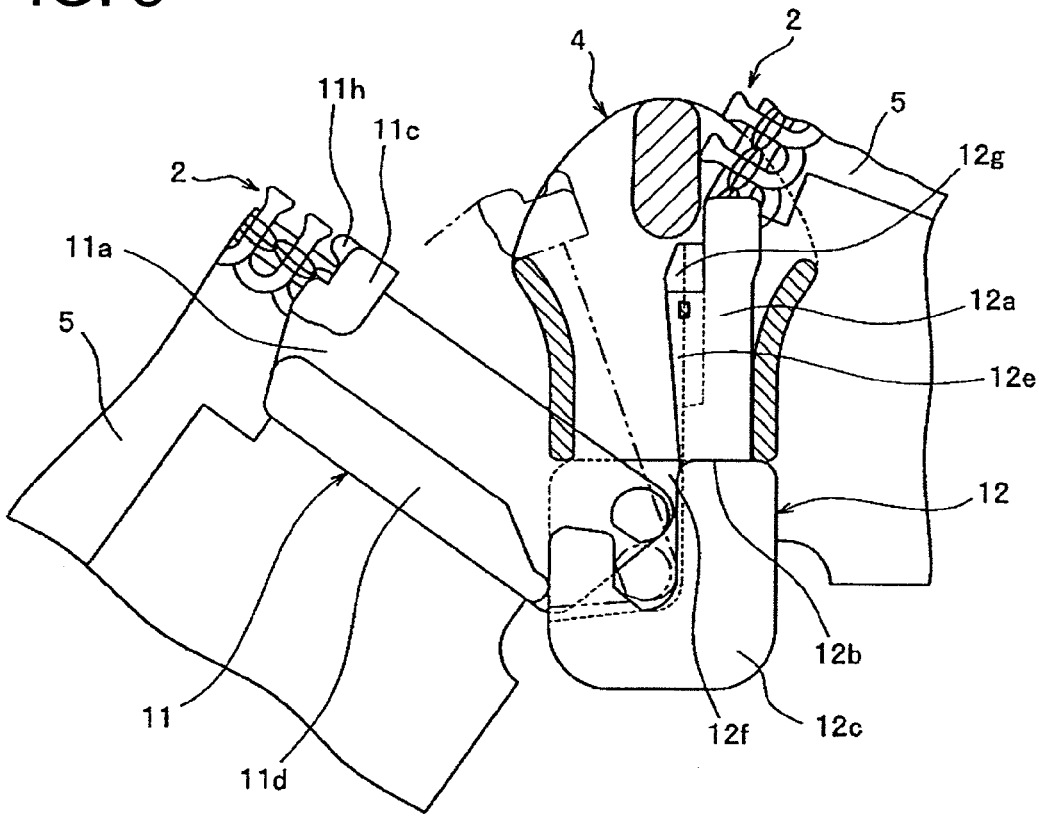
FIG. 8 is an explanatory view for explaining movement of a pivot shaft portion when opening the slide fastener.

Thereafter, the insert member 11 rotates centering on the pivot shaft portion 11*b* counterclockwise to be apart from the pivot support member 12. As a result, the insert plate portion 11*a* of the insert member 11 is pulled out of the element guide passage 4*h* of the slider 4. As the insert member 11 further rotates, as illustrated in FIG. 8, the lower end of the first projecting portion 11*d* disposed at the upper surface side of the insert plate portion 11*a* contacts the box portion 12*c*, and the lower end of the second projecting portion 11*e* disposed on the lower surface side contacts the flat plate-like support portion 12*f*. Thereafter, the insert member 11 rotates counterclockwise using the contact points as a support point. Thus, the pivot shaft portion 11*b* of the insert member 11 is easily extracted from the box portion 12*c* in the left direction through the space portion 12*i* between the rear end portion of the slider 4 and the leading end portion of the box portion 12*c* at the curved side, and thus the slide fastener 1 can be smoothly opened.

In the present first embodiment, when extracting the pivot shaft portion 11*b* of the insert member 11 from the box portion 12*c*, the pivot shaft portion 11*b* of the insert member 11 may be extracted from the space portion 12*i* through the element guide passage 4*h* of the slider 4 instead of being extracted through the above described space portion 12*i* in the left direction.

Second Embodiment

Figure 9:
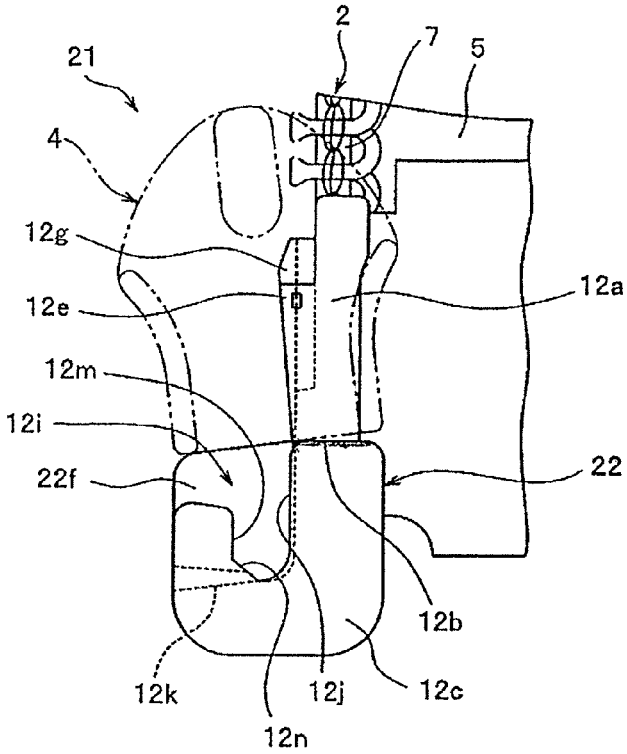
FIG. 9 is a front view illustrating a pivot support member of a slide fastener with a separable bottom end stop according to a second embodiment of the invention.

FIG. 9 is a front view illustrating a pivot support member of a slide fastener with a separable bottom end stop according to a second embodiment of the invention.

In the present second embodiment, parts or members having the same configuration as the parts or members described in the first embodiment are denoted by the same symbols, and thus a description thereof will not be repeated.

In a slide fastener 21 of the present second embodiment, a pivot support member 22 is formed such that a front end surface of a flat plate-like support portion 22*f* has an inclined surface that is inclined downward to the rear end side as it gets away from the fastener tape 5 in the tape width direction. Further, in the slide fastener 21 of the present second embodiment, the remaining configuration except the front end surface of the flat plate-like support portion 22*f* is basically the same as in the slide fastener 1 of the first embodiment.

In the slide fastener 21 of the present second embodiment, since the slider 4 is held on the box pin portion 12*a* and the rear end of the slider 4 comes in surface contact with the first step portion 12*b* of the pivot support member 22, the posture of the slider 4 can be straightly maintained in the tape length direction similarly to the first embodiment. Further, by having the rear end of the slider 4 come in surface contact with the front end surface of the flat plate-like support portion 22*f*, the posture of the slider 4 can be maintained to a state inclined counterclockwise with respect to the tape length direction in a front view as illustrated in FIG. 9.

As a result, for example, in the case of using the first operation method (that is, the case of inserting the pivot shaft portion 11*b* of the insert member 11 from the left side of the pivot support member 22) so as to pivot-support the pivot shaft portion 11*b* of the insert member 11 on the box portion 12*c* of the pivot support member 22, by having the rear end of the slider 4 come in surface contact with the first step portion 12*b* of the pivot support member 22, the posture of the slider 4 is straightly maintained in the tape length direction, and thus the pivot shaft portion 11*b* of the insert member 11 can be smoothly inserted toward the box portion 12*c* of the pivot support member 22 and pivot-supported on the box portion 12*c*.

Meanwhile, for example, in the case of using the second operation method (that is, the case of inserting the pivot shaft portion 11*b* of the insert member 11 through the element guide passage 4*h* of the slider 4) so as to pivot-support the pivot shaft portion 11*b* of the insert member 11 on the box portion 12*c* of the pivot support member 22, by having the rear end of the slider 4 come in surface contact with the front end surface of the flat plate-like support portion 22*f*, the posture of the slider 4 is maintained in the inclined state, and thus the pivot shaft portion 11*b* of the insert member 11 can be smoothly inserted toward the box portion 12*c* of the pivot support member 22 and pivot-supported on the box portion 12*c*.

That is, in the slide fastener 21 of the present second embodiment, it is possible to easily change the posture of the slider 4 according to the operation method of pivot-supporting the pivot shaft portion 11*b* of the insert member 11 on the box portion 12*c*. As a result, the operation of pivot-supporting the pivot shaft portion 11*b* of the insert member 11 on the box portion 12*c* can be more smoothly performed, and thus the operability of the slide fastener 21 can be further improved.

The invention claimed is:

1. A slide fastener with a separable bottom end stop, comprising:

a slider that passes through first and second element rows each including coil- or zigzag-shaped continuous fastener elements fixed to opposing tape side edge portions of a pair of left and right fastener tapes;

an insert member fixed to an end of the first element row; and a pivot support member fixed to an end of the second element row, wherein the insert member includes an insert plate portion of a thin plate form that is fixed to front and back tape surfaces of one of the fastener tapes and has first and second surfaces, and a pivot shaft portion disposed to protrude on an end portion of the insert plate portion at a side opposite to the first element row, the pivot support member includes first and second surfaces and includes a box pin portion that extends from an end of the second element row to a tape end portion side in a tape length direction and holds the slider and a box portion that extends from the box pin portion through a first step portion, the box portion having a nearly J shape that allows the pivot shaft portion to be engageable and disengageable with a J-shaped inner wall surface from a side of the pivot support member and to be engageable and disengageable with the J-shaped inner wall surface through an element guide passage formed inside the slider, the pivot shaft portion is disposed to protrude only on the first surface of the insert plate portion, the second surface of the insert plate portion is formed into a flat surface, a height dimension from the second surface of the insert plate portion to a first surface of the pivot shaft portion in a tape front and rear direction is set smaller than a distance between upper and lower blades of the slider and larger than a tape groove of the slider, the pivot support member includes a protrusion that extends toward a tape outer side from a first surface side of the box pin portion and supports the first surface side of the insert plate portion at the time of coupling of the first and second element rows and a flat plate-like support portion that extends toward the tape outer side from a second surface side of the box portion, so that the flat plate-like support portion extends behind the nearly J-shape of the box portion, and the flat plate-like support portion supports the second surface side of the insert plate portion at the time of coupling of the first and second element rows, and wherein a side end surface of the flat plate-like support portion which faces the insert member lies in a same plane surface as an outer wall surface of the box portion and the side end surface extends beyond an upper edge of the outer wall surface of the box portion in the tape length direction.

* * * * *

UNITED STATES PATENT AND TRADEMARK OFFICE

CERTIFICATE OF CORRECTION

PATENT NO. : 8,813,319 B2
APPLICATION NO. : 13/255325
DATED : August 26, 2014
INVENTOR(S) : Suguru Ogura It is certified that error appears in the above-identified patent and that said Letters Patent is hereby corrected as shown below:

Title page, item (57), Abstract, in column 2, line 8, Delete "J shape" and insert --J-shape--, therefor.

In the Specification

In column 6, line 67, Delete "row.is" and insert --row is--, therefor.

In the Claims

In column 20, line 4, Claim 1, Delete "J shape" and insert --J-shape--, therefor.

Signed and Sealed this
Tenth Day of March, 2015

Michelle K. Lee

Michelle K. Lee
*Deputy Director of the United States Patent and Trademark Office*